US007798866B2

(12) United States Patent
Hetzer et al.

(10) Patent No.: US 7,798,866 B2
(45) Date of Patent: Sep. 21, 2010

(54) ELECTRICAL PLUG-IN CONNECTOR

(75) Inventors: Ulrich Hetzer, Berlin (DE); Frank Mössner, Berlin (DE); Ferenc Nad, Berlin (DE)

(73) Assignee: ADC GmbH, Berlin (DE)

( * ) Notice: Subject to any disclaimer, the term of this patent is extended or adjusted under 35 U.S.C. 154(b) by 0 days.

(21) Appl. No.: 12/522,972

(22) PCT Filed: Dec. 13, 2007

(86) PCT No.: PCT/EP2007/010934

§ 371 (c)(1),
(2), (4) Date: Jul. 13, 2009

(87) PCT Pub. No.: WO2008/086866

PCT Pub. Date: Jul. 24, 2008

(65) Prior Publication Data

US 2010/0003862 A1 Jan. 7, 2010

(30) Foreign Application Priority Data

Jan. 18, 2007 (DE) ..... 10 2007 002 766

(51) Int. Cl.
*H01R 24/00* (2006.01)

(52) U.S. Cl. ..... 439/676

(58) Field of Classification Search ..... 439/676, 439/76.1

See application file for complete search history.

(56) References Cited

U.S. PATENT DOCUMENTS

| | | | | |
|---|---|---|---|---|
| 4,720,269 | A * | 1/1988 | Haskins et al. | 439/90 |
| 5,479,320 | A | 12/1995 | Estes et al. | |
| 6,089,894 | A | 7/2000 | Fletcher | |
| 6,155,882 | A | 12/2000 | Wu | |
| 6,953,362 | B2 | 10/2005 | Mossner et al. | |
| 6,981,887 | B1 | 1/2006 | Mese et al. | |
| 7,040,933 | B1 * | 5/2006 | Ma | 439/676 |
| 7,252,554 | B2 * | 8/2007 | Caveney et al. | 439/676 |

FOREIGN PATENT DOCUMENTS

| | | |
|---|---|---|
| DE | 102 59 277 | 7/2004 |
| DE | 10 2004 041 207 | 3/2006 |
| EP | 1 312 137 | 5/2005 |

* cited by examiner

*Primary Examiner*—Phuong K Dinh
(74) *Attorney, Agent, or Firm*—Merchant & Gould P.C.

(57) ABSTRACT

The invention relates to an electrical plug-in connector (1) comprising a housing, a printed circuit board (6), and at least one electrical contact which is electrically connected to the printed circuit board. The printed circuit board (6) is spring-mounted.

10 Claims, 5 Drawing Sheets

ELECTRICAL PLUG-IN CONNECTOR

This application is a National Stage Application of PCT/EP2007/010934, filed 13 Dec. 2007, which claims benefit of Ser. No. 10 2007 002 766.6, filed 18 Jan. 2007 in Germany and which applications are incorporated herein by reference. To the extent appropriate, a claim of priority is made to each of the above disclosed applications.

BACKGROUND

An electrical plug-in connector is known, for example, in the form of an RJ45 socket from EP 1 312 137 B1. In this case, the plug-in connector has a housing, in which a printed circuit board is arranged with sprung RF contacts, which are electrically connected to the printed circuit board. If a mating connector or complementary plug-in connector in the form of an RJ45 plug is now plugged into the socket, the RF contacts of the socket thus come into contact with the corresponding mating contacts of the plug. Owing to the unavoidable tolerances of the housing of the plug and also of the socket, the RF contacts need to be capable of covering correspondingly long spring paths in order to in each case produce a reliable electrical contact with sufficient contact force. This requires relatively long RF contacts, which in turn is disadvantageous with respect to the electrical transmission properties.

SUMMARY

The invention is therefore based on the technical problem of providing an electrical plug-in connector which has improved electrical transmission properties.

In this regard, the electrical plug-in connector comprises a housing, a printed circuit board and at least one electrical contact, which is electrically connected to the printed circuit board, the printed circuit board being mounted in a sprung manner. The basic concept of the invention here is not to apply the entire excursion for compensating for the tolerances by the electrical contacts but to apply it in part by a sprung movement of the printed circuit board itself. Therefore, the electrical contacts can then be designed to be shorter, with the result that the electrical transmission properties are improved. The sprung mounting can be achieved, for example, by fixed clamping at one end of the printed circuit board in a similar manner to a springboard. For this purpose, the printed circuit board then needs to be designed to be sufficiently long for it to be sprung to a sufficient extent. However, the printed circuit board is preferably mounted via an elastic element.

In a further preferred embodiment, the printed circuit board is prestressed by the elastic element, with the result that, even in the case of a path of zero, a force already acts on the printed circuit board. The advantage is in particular that of overcoming frictional forces such that the printed circuit board then carries out the excursion directly if the mating connector is pressing.

In a further preferred embodiment, at least one intermediate piece is arranged between the elastic element and the printed circuit board. As a result, the spring force can be transmitted more uniformly onto the printed circuit board.

In a further preferred embodiment, the elastic element is in the form of a rubber element, elastomer or in the form of a metal spring.

In a further preferred embodiment, the electrical contact(s) is or are prestressed by a comb element. As a result, a sufficient contact force is ensured if the mating plug-in connector is not pressed heavily against the electrical contacts.

In a further preferred embodiment, the comb element has a stop edge or face for the mating plug-in connector, which delimits the maximum excursion of the printed circuit board.

In a further preferred embodiment, the housing is designed to have at least two parts, the elastic element being mounted in a first housing part, the printed circuit board being mounted fixedly in a second housing part, and the first and second housing parts being connected to one another such that they can move. As a result, in particular in designs where the second housing part has further contacts, for example insulation displacement contacts, which are likewise connected to the printed circuit board, forces, as a result of the movements of the printed circuit board, at the contact points between these further contacts and the printed circuit board are prevented from occurring which could possibly result in soldered joints being torn away. The movement of the printed circuit board is therefore absorbed by the movable connection between the first and second housing parts.

In a further preferred embodiment, the first housing part and the second housing part are connected to one another via a pivot-bearing arrangement. In this case, the first housing part is preferably formed with at least one cylinder pin, and the second housing part is preferably formed with at least one receptacle for the cylinder pin, further preferably two cylinder pins and two receptacles being provided.

In a preferred embodiment, the electrical plug-in connector is in the form of an RJ45 socket.

BRIEF DESCRIPTION OF THE DRAWINGS

The invention will be explained in more detail below with reference to a preferred exemplary embodiment. In the figures.

DETAILED DESCRIPTION

Figure 1:
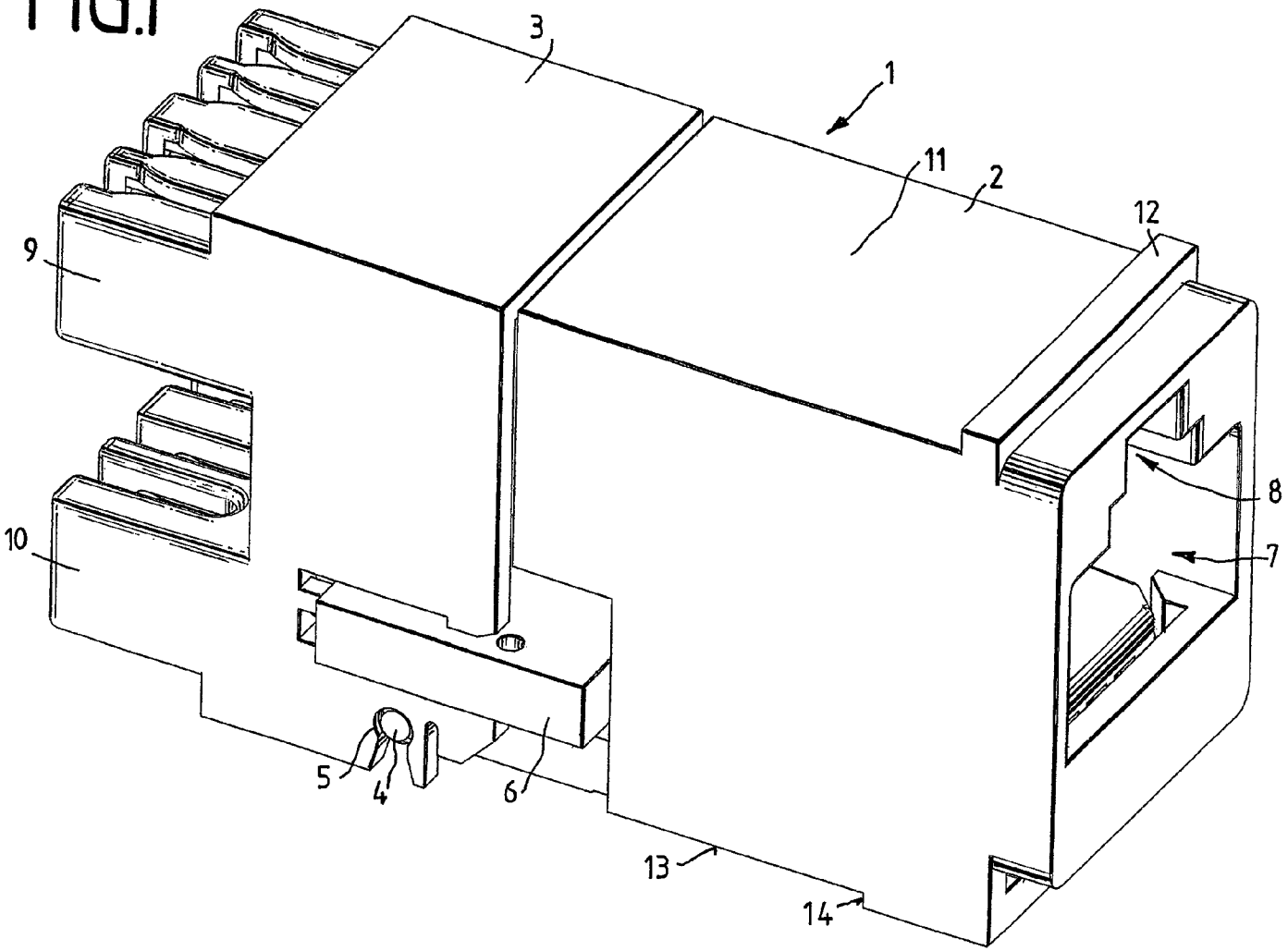
FIG. 1 shows a perspective illustration of an electrical plug-in connector.

FIG. 1 illustrates an electrical plug-in connector 1, which is in the form of an RJ45 socket. The plug-in connector 1 comprises a first housing part 2 and a second housing part 3, which are connected to one another such that they can move via a pivot-bearing arrangement. The pivot-bearing arrangement is in this case formed by two cylinder pins 4 on the first housing part 2 and two correspondingly integrally formed receptacles 5 for the cylinder pins on the second housing part 3. Furthermore, the plug-in connector 1 comprises a printed circuit board 6, which is mounted fixedly in the second housing part 3. In the first housing part 2, the printed circuit board 6 is prestressed by an elastic element, which will be explained later in more detail with reference to FIG. 2. The first housing part 2 has an opening 7 for receiving a mating plug (not illustrated). The opening 7 in this case has a narrower guide 8 in the upper region, behind which guide a latching clip of the mating plug can latch in. The second housing part 3 has two rows 9, 10 on the other side with clamping ribs, between which in each case insulation displacement contacts are guided. The first housing part 2 has a stop edge 12 on the upper side 11 and a stop edge 14 on the lower side 13.

Figure 2:
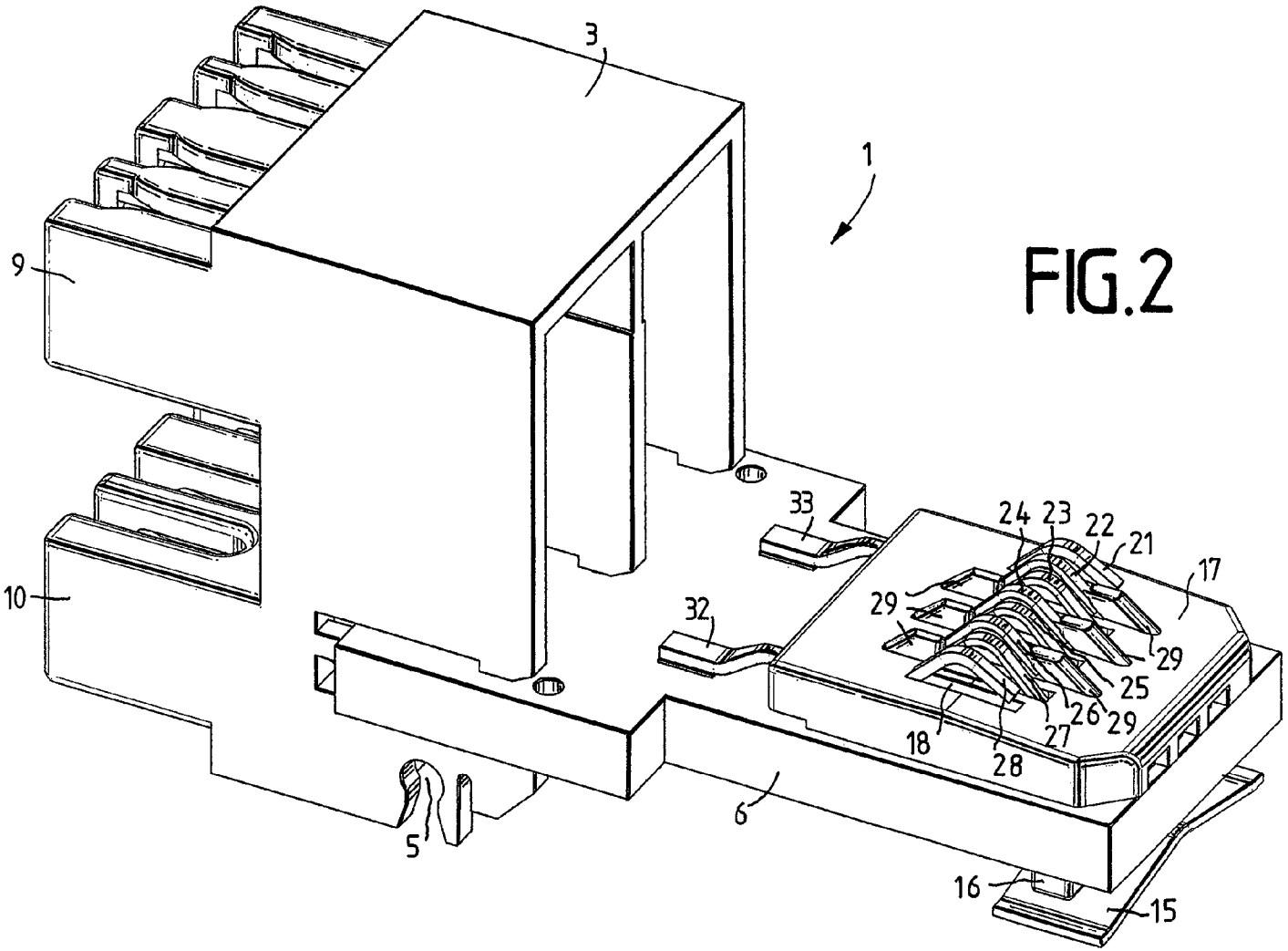
FIG. 2 shows a perspective illustration of the electrical plug-in connector with the first housing part removed.
Figure 4:
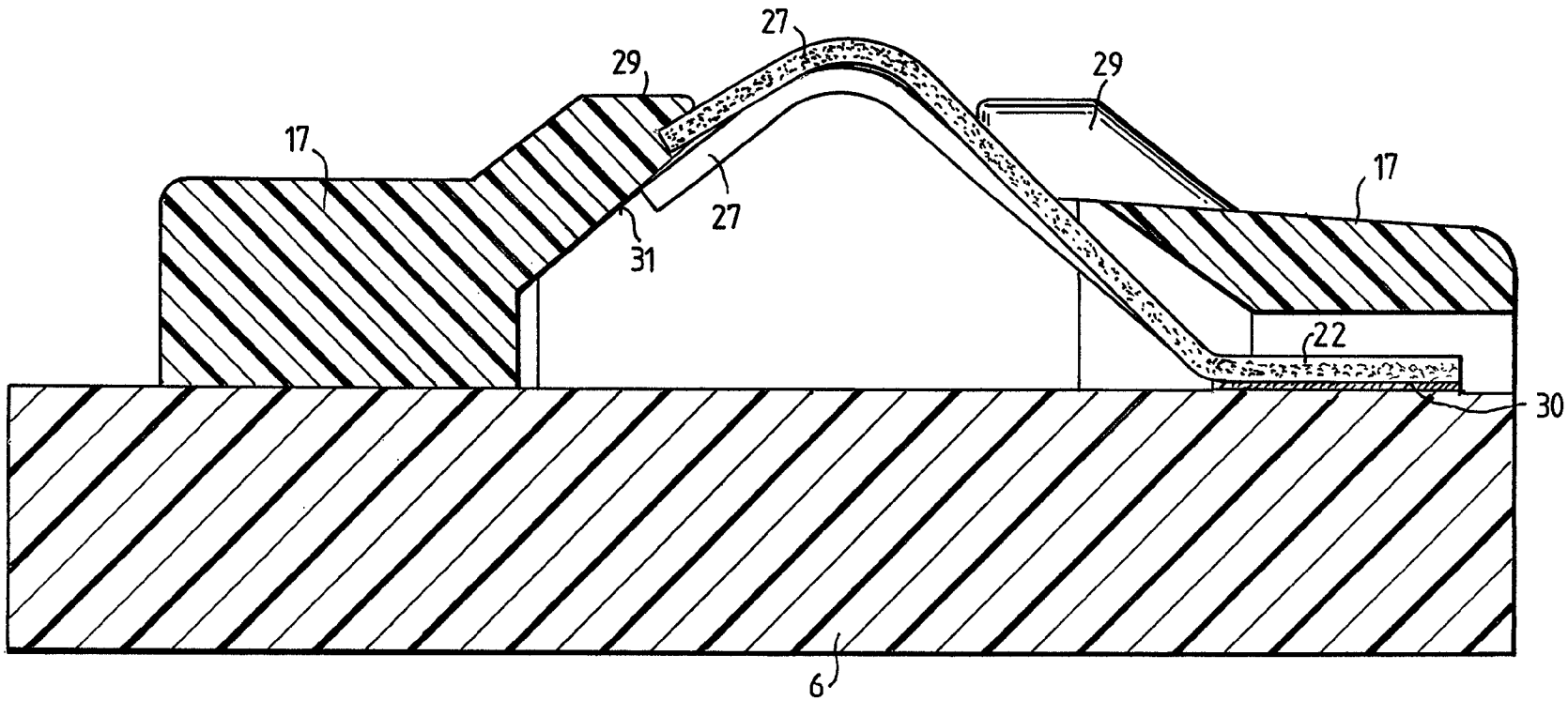
FIG. 4 shows a partial cross section through a printed circuit board with the comb element.

FIG. 2 shows an elastic element 15 in the form of a leaf spring, which is arranged in the region of the first housing part 2, and an intermediate piece 16, which is arranged between the elastic element 15 and the printed circuit board 6 and transmits the spring force of the elastic element 15 onto the printed circuit board 6. In this case, the elastic element 15 is mounted in the first housing part (not illustrated). A comb element 17 can be seen on the upper side of the printed circuit board 6. The comb element 17 has slots 18, through which the RF contacts 21-28 with which contact is made on the printed circuit board 6 protrude. Furthermore, the comb element 17 comprises guide webs 29, which separate the individual RF contacts 21-28 from one another. The comb element 17 not only guides the RF contacts 21-28 but also prestresses them. This can be seen best in FIG. 4. The RF contact, for example the RF contact 27, is in this case fixedly connected to the printed circuit board 6 at a contact point 30 and, on the opposite side of the slot, clamped using the comb element 17 at one edge 31, with the result that the RF contact 27 has a prestress. In this case, the part illustrated with black dots represents the RF contact 27 without the prestress and the part illustrated without dots represents the RF contact 27 in the prestressed position. This prestress ensures that sufficient contact force is applied when contact is made with the mating contacts of the mating plug. The RF contact 27 is connected both mechanically and electrically to the printed circuit board at the contact point 30.

Owing to the elastic element 15, the printed circuit board 6 is now elastically prestressed. This makes it possible to compensate for tolerances of the mating plug with respect to the plug-in connector 1. This can be clearly explained as follows. The printed circuit board 6 is upwardly prestressed. If the tolerances of the mating plug were to produce an excessively low pressure downwards onto the RF contacts 21-28, this would now be assisted by the prestress of the printed circuit board 6. If the tolerances of the mating plug are such that the space for the mating plug is too small, it presses the sprung printed circuit board downwards. Expressed in simplified terms, the tolerances of the mating plug are compensated for by the sprung printed circuit board 6 and no longer by the sprung RF contacts, as in the prior art. At the same time, the comb element 17 is used on its upper side as a stop for the mating plug.

Figure 5:
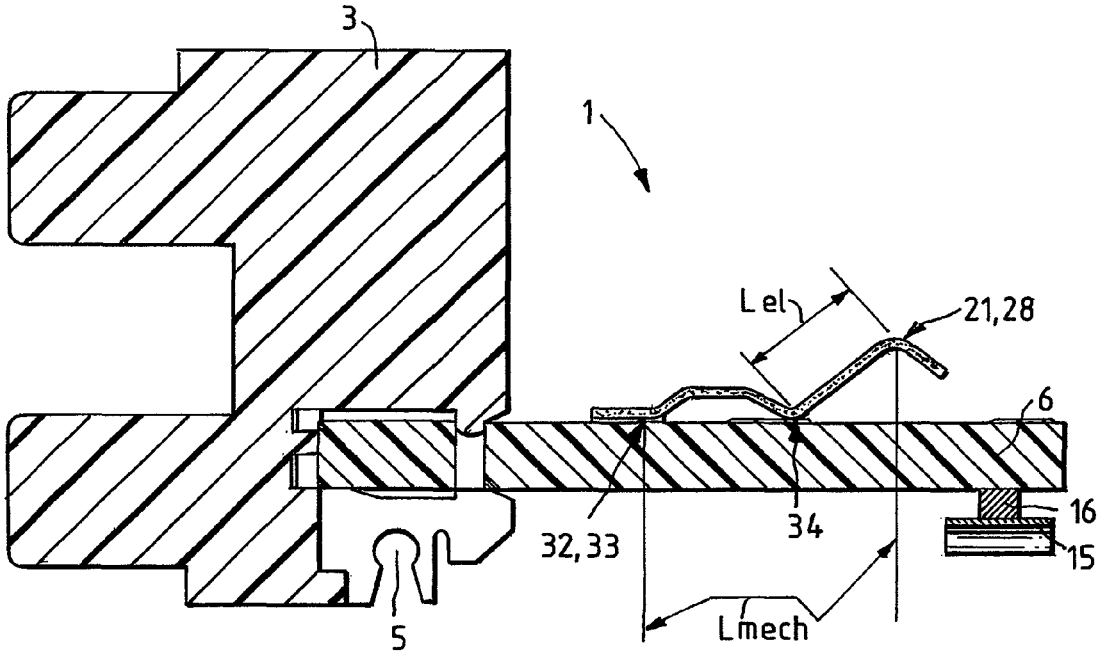
FIG. 5 shows a side view of a mechanically extended contact.

The two outer RF contacts 21 and 28 preferably have another embodiment since they are at particular risk if, for example, an RJ11 plug is plugged into the plug-in connector, since this has lower-lying housing parts at the contact points. A particular technique is therefore used in the case of the RF contacts 21, 28 in which the electrical and mechanical contact points are separated. For this purpose, the RF contact 21, 28 is clamped at the electrical contact point 34 only in a sprung manner against the mating contact point on the printed circuit board 6, whereas the extended RF contact is then mechanically fixed at a remote contact point 32, 33 (see FIG. 5). The mechanical contact points 32, 33 can be seen here in FIGS. 2 and 3. This means that, mechanically, the RF contacts 21, 28 can spring to a more pronounced extent without their electrical properties being impaired. The electrical contact length el is therefore shorter than the mechanical contact length mech.

Figure 3:
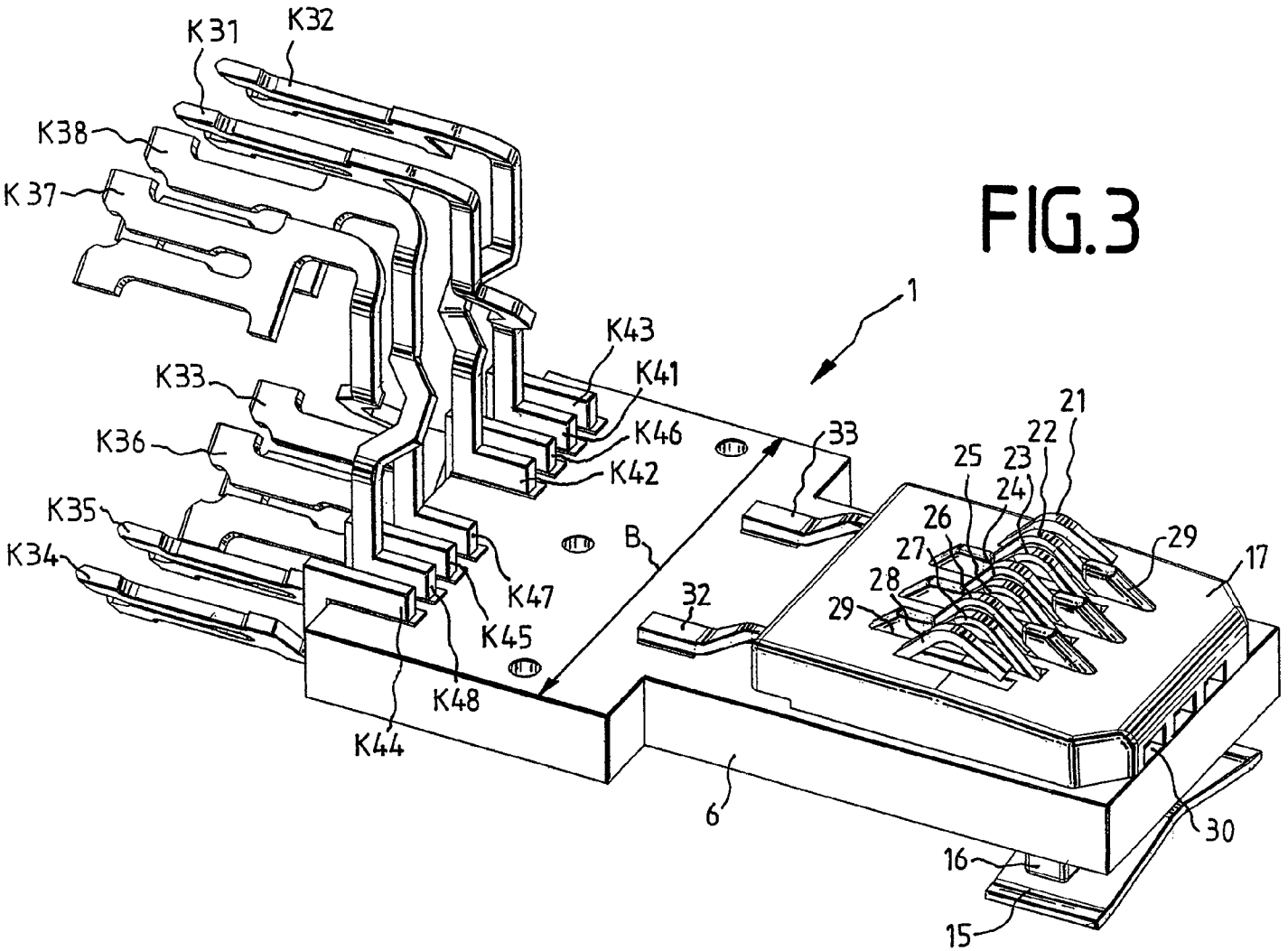
FIG. 3 shows a perspective illustration of the electrical plug-in connector without the housing parts.

FIG. 3 now also shows the insulation displacement contacts K31-K38, which are connected to the printed circuit board 6 via SMD-like contacts K41-K48. In this case, the insulation displacement contacts K31, K32 and K37, K38 are in the row 9 (see FIG. 2). Correspondingly, the insulation displacement contacts K33-K36 are in the second row 10 (see FIG. 2). The insulation displacement contacts K31, K32 and K37, K38 are arranged considerably further away from the printed circuit board 6 than the insulation displacement contacts K33-K36. As a result, the crosstalk normally increases since the total contact length up to the SMD-like contacts K41, K42, K47, K48 is longer. In order to compensate for this, as can be seen the insulation displacement contacts K31 and K32 and the insulation displacement contacts K37 and K38 are therefore crossed over. The advantage of designing the associated insulation displacement contacts K31, K32, K37, K38 of the two outer RF contact pairs K21, K22 and K27, K28 to be longer is that they are less critical in terms of crosstalk than the two inner contact pairs K23, K26; K24, K25. This configuration is therefore preferable in comparison with longer insulation displacement contacts K33-K36 of the inner contact pairs. Owing to the arrangement of the insulation displacement contacts K31-K38 in two parallel rows over the width B of the printed circuit board, whereby one row is offset from the surface of the printed circuit board, the plug-in connector can be designed to be narrower in the rear region, with the result that, in total, the number of plug-in connectors in one panel can be increased. For this purpose, the contact pairs K31, K32 and K37, K38 are brought slightly closer together. The same applies for the contact pairs K34, K35 and K33, K36 of the lower row. In this case, it can further be seen that the longitudinal axes of the insulation displacement contacts K31-K38 lie parallel to the surface of the printed circuit board 6. It can further be seen that the insulation displacement contacts K31, K32; K37, K38; K34, K35 and K33, K36 are aligned parallel to one another, the adjacent contact pairs K31, K32 and K37, K38 being arranged such that they are rotated towards one another through 90°, as a result of which the crosstalk is reduced. The same applies for the contact pairs K34, K35 and K33, K36, which are also arranged such that they are rotated towards one another through 90°.

The inner RF contacts 22-27 are arranged alternately with respect to one another, i.e. they are fixed to the printed circuit board alternately on the left and on the right with respect to the contact region of the RF contacts 22-27, preferably as SMD contacts. The RF contact 27 is, for example, fixed on the right-hand side and is bent towards the left, whereas the RF contact 26 is fixed on the left-hand side and is bent towards the right. As a result, the capacitive coupling of adjacent RF contacts is reduced since they are only opposite one another in the vicinity of the contact region.

LIST OF REFERENCE SYMBOLS

1 Plug-in connector
2 First housing part
3 Second housing part
4 Cylinder pin
5 Receptacle
6 Printed circuit board
7 Opening
8 Guide
9, 10 Rows
11 Upper side
12 Stop edge
13 Lower side
14 Stop edge
15 Elastic element
16 Intermediate piece
17 Comb element
18 Slots
21-28 RF contacts
29 Guide web
30 Contact point

31 Edge
32, 33 Mechanical contact points
34 Electrical contact point
K31-K38 Insulation displacement contacts
K41-K48 SMD-like contacts

The invention claimed is:

1. An electrical plug-in connector, comprising:

a housing, a printed circuit board, and at least one electrical contact, which is electrically connected to the printed circuit board, wherein the printed circuit board is mounted in a sprung manner, wherein the printed circuit board is mounted via an elastic element, and wherein the housing is designed to have at least two parts, the elastic element being mounted in a first housing part, the printed circuit board being mounted fixedly in a second housing part, and the first and second housing parts being connected to one another such that they can move.

2. The electrical plug-in connector as claimed in claim 1, wherein the printed circuit board is prestressed via the elastic element.

3. The electrical plug-in connector as claimed in claim 1, wherein at least one intermediate piece is arranged between the elastic element and the printed circuit board.

4. The electrical plug-in connector as claimed in claim 1, wherein the elastic element is in the form of a rubber element, elastomer or in the form of a metal spring.

5. The electrical plug-in connector as claimed in claim 1, wherein the electrical contacts are prestressed by a comb element.

6. The electrical plug-in connector as claimed in claim 5, wherein the electrical contacts are guided in the comb element.

7. The electrical plug-in connector as claimed in claim 1, wherein the first housing part and the second housing part are connected to one another via a pivot-bearing arrangement.

8. The electrical plug-in connector as claimed in claim 7, wherein the first housing part is formed with at least one cylinder pin.

9. The electrical plug-in connector as claimed in claim 1, wherein the electrical plug-in connector is in the form of an RJ45 socket.

10. The electrical plug-in connector as claimed in claim 5, wherein the comb element has an edge that retains the electrical contacts to prestress the electrical contacts.

* * * * *